US008282028B2

(12) United States Patent
Nakada et al.

(10) Patent No.: US 8,282,028 B2
(45) Date of Patent: Oct. 9, 2012

(54) ELECTROSTATICALLY ATOMIZING DEVICE

(75) Inventors: Takayuki Nakada, Hikone (JP); Hiroshi Suda, Takatsuki (JP); Masaharu Machi, Shijonawate (JP); Sumio Wada, Hikone (JP); Atsushi Isaka, Hikone (JP); Akihide Sugawa, Hikone (JP)

(73) Assignee: Panasonic Corporation, Osaka (JP)

( * ) Notice: Subject to any disclaimer, the term of this patent is extended or adjusted under 35 U.S.C. 154(b) by 367 days.

(21) Appl. No.: 12/293,242

(22) PCT Filed: Mar. 13, 2007

(86) PCT No.: PCT/JP2007/054907

§ 371 (c)(1), (2), (4) Date: Sep. 16, 2008

(87) PCT Pub. No.: WO2007/111120

PCT Pub. Date: Oct. 4, 2007

(65) Prior Publication Data

US 2009/0114747 A1 May 7, 2009

(30) Foreign Application Priority Data

Mar. 29, 2006 (JP) ..... 2006-092196

(51) Int. Cl.
*B05B 5/00* (2006.01)
*B05B 5/025* (2006.01)
*F23D 11/32* (2006.01)

(52) U.S. Cl. ..... 239/690.1; 239/690; 239/706; 239/708; 427/483

(58) Field of Classification Search ..... 239/102.1, 239/102.2, 690, 690.1, 706, 708; 427/483
See application file for complete search history.

(56) References Cited

U.S. PATENT DOCUMENTS

| | | | | |
|---|---|---|---|---|
| 3,911,161 | A * | 10/1975 | Nord et al. | 427/483 |
| RE30,479 | E * | 1/1981 | Cohen et al. | 95/71 |
| 6,471,753 | B1 | 10/2002 | Ahn et al. | |
| 6,679,441 | B1 | 1/2004 | Borra et al. | |
| 7,150,412 | B2 * | 12/2006 | Wang et al. | 239/102.1 |
| 2003/0093228 | A1 | 5/2003 | Takeuchi et al. | |
| 2005/0056713 | A1 * | 3/2005 | Tisone et al. | 239/690 |
| 2005/0116069 | A1 | 6/2005 | Murata | |

(Continued)

FOREIGN PATENT DOCUMENTS

CN 1635933 A 7/2005

(Continued)

OTHER PUBLICATIONS

Taiwanese Office Action for the Application No. 096109376 from Taiwan Patent Office mailed Feb. 9, 2010.

(Continued)

*Primary Examiner* — Len Tran
*Assistant Examiner* — Ryan Reis
(74) *Attorney, Agent, or Firm* — Cheng Law Group, PLLC

(57) ABSTRACT

The liquid supplied to an emitter electrode located at a tip of an atomization nozzle receives the high-voltage and electrically charged. The mist of the charged minute water particles of nanometer sizes is generated from the emitter electrode. A pressure regulating means regulates a pressure applied to the liquid on the tip of the emitter electrode. Therefore, the mode of generating the mist of the charged minute water particles of nanometer sizes or the mode of generating the mist of the charged minute water particles of nanometer and micron size is selected.

14 Claims, 2 Drawing Sheets

U.S. PATENT DOCUMENTS

| | | | | |
|---|---|---|---|---|
| 2006/0214020 | A1 | 9/2006 | Suda et al. | |
| 2007/0290080 | A1 * | 12/2007 | Okumoto et al. | 239/690 |

FOREIGN PATENT DOCUMENTS

| | | | | |
|---|---|---|---|---|
| EP | 0 486 198 | A1 | | 5/1992 |
| EP | 1 477 230 | A1 | | 11/2004 |
| EP | 1 964 614 | A1 | | 9/2008 |
| JP | 05-345156 | A | | 12/1993 |
| JP | 09-010632 | A | | 1/1997 |
| JP | 09010632 | A | * | 1/1997 |
| JP | 2001-170514 | A | | 6/2001 |
| JP | 2003-149124 | A | | 5/2003 |
| JP | 2004-165587 | A | | 6/2004 |
| JP | 2004-361009 | A | | 12/2004 |
| JP | 2005-66585 | A | | 3/2005 |
| JP | 2005-164139 | A | | 6/2005 |
| JP | 2005-336844 | A | | 12/2005 |
| TW | 572789 | | | 1/2004 |
| WO | WO-2006/009189 | A1 | | 1/2006 |

OTHER PUBLICATIONS

Supplementary European Search Report for the Application No. EP 07 73 8379 dated Feb. 20, 2009.

Cloupeau, M. et al., "Electrostatic Spraying of Liquids in Cone-Jet Mode", Journal of Electrostatics, Jul. 1989, vol. 22, No. 2, pp. 135-159.

Cloupeau, M. et al., "Electrohydrodynamic Spraying Functioning Modes: A Critical Review", Journal of Aerosol Science, 1994, vol. 25, No. 6, pp. 1021-1036.

Notification of Reasons for Refusal for the Application No. 2006-092196 from Japan Patent Office mailed Apr. 14, 2009.

International Search Report for the Application No. PCT/JP2007/054907 mailed Jun. 5, 2007.

Notification of the First Office Action for Application No. 200780011366.7 from the State Intellectual Property Office of People's Republic of China dated Sep. 1, 2010.

* cited by examiner

ELECTROSTATICALLY ATOMIZING DEVICE

TECHNICAL FIELD

This invention relates to an electrostatically atomizing device which is capable of generating a mist of charged minute particles of nanometer-sizes which is mixed with a mist of charged minute particles of micron-sizes as necessary.

BACKGROUND ART

Japanese patent application no. H5-345156 discloses an electrostatically atomizing device which is configured to electrostatically atomize water to generate a mist of the charged minute water particles. The electrostatically atomizing device is configured to cause the water supplied to the emitter electrode to generate a Rayleigh breakup for atomizing the water, thereby generating the mist of the charged minute water particles of nanometer sizes. The mist of the charged minute water particles includes radicals and is capable of floating in a room for many hours. The mist of the charged minute water particles is capable of diffusing into the room and is capable of adhering and penetrating to substances at the room where the mist is diffused, thereby effectively sterilizing and deodorizing the substances. The mist of the charged minute water particles is capable of humidifying the room. However, the mist of the charged minute water particles has diameters of the nanometer-sizes. That is, even if a large amount of the mist is discharged, the mist of the charged minute water particles of nanometer-sizes is not capable of sufficiently humidifying the room. In such matter, the electrostatically atomizing device is generally used with a traditional humidifier which generates water vapor when humidification is required.

DISCLOSURE OF THE INVENTION

In view of the above problem, the present invention is achieved to provide an electrostatically atomizing device which has functions of decomposing harmful substances, sterilizing the substances, and deodorizing the substances and which has a function of adding a humidifying function as necessary.

The electrostatically atomizing device in accordance with the present invention comprises a tubular atomization nozzle, a supply tank, and a high-voltage source. The tubular atomization nozzle has an emitter electrode at its tip. The supply tank is configured to contain a volume of liquid and is configured to supply the liquid to the atomization nozzle. The high-voltage source is configured to apply a high-voltage to the emitter electrode to electrostatically charge the liquid which is supplied to the emitter electrode for generating a mist of charged minute liquid particles from the tip of the emitter electrode.

The water supplied to the emitter electrode is formed into a water ball at the tip of the emitter electrode by a surface tension. The high-voltage source applies the high-voltage to the tip of the emitter electrode, forms a Taylor cone at the water ball which is held at the tip of the emitter electrode, and then concentrates electric charges at a tip of the Taylor cone. The tip of the Taylor cone is charged electrically, and then breaks up, so that the tip of the Taylor cone generates a mist of charged minute water particles of nanometer sizes of 3 nm to 100 nm, and then is diffused. At this moment, a water in the supply tank applies the water head pressure to the Taylor cone and tilts a balance of the surface tension. Consequently, the portion other than the tip of the Taylor cone breaks up. The portion other than the tip of the Taylor cone concentrates little electrical charge. Therefore, the portion other than the tip of the Taylor cone has little energy to break up, thereby mainly generating a mist of charged minute water particles of micron sizes of 0.1 μm to 10 μm. The mist of the charged minute water particles of nanometer sizes has radicals, and is capable of decomposing harmful substances, sterilizing the space, and deodorizing the space by the radicals. The mist of the charged minute water particles of micron sizes is capable of humidifying the space effectively.

The feature of the invention resides in that the electrostatically atomizing device includes a pressure regulating means which is configured to regulate a pressure applied to the liquid at the tip of the atomization nozzle. With this configuration, by regulating the pressure applied to the tip of the water, Taylor cone, it is possible to obtain the electrostatically atomizing device which has a mode to generate the breakup only at the tip of the Taylor cone, and which has the other mode to generate the breakup at the portion other than the tip of the Taylor cone as well as to also generate the breakup at the tip of the Taylor cone. Consequently, the electrostatically atomizing device is configured to mainly generate the mist of the charged minute water particles of nanometer sizes. Furthermore, the electrostatically atomizing device is also configured to generate the mist of the charged minute water particles of nanometer sizes as well as to generate the mist of the charged minute water particles of micron sizes. As a result, the electrostatically atomizing device is capable of switching the two operations selectively. Therefore, the electrostatically atomizing device has functions of decomposing the harmful substances, sterilizing and deodorizing by a great deal of radicals that the mist of the charged minute water particles of nanometer sizes has. In addition, the electrostatically atomizing device has functions of humidifying the room as well as has functions of decomposing the harmful substances, sterilizing and deodorizing by a great deal of radicals that the mist of the charged minute water particles of nanometer sizes has. As a result, the electrostatically atomizing device is capable of operating anyone of above functions according to circumstances.

The pressure regulating means comprises a replenishing means, a controller, and an operation selection switch. The replenishing means is for replenishing the liquid to the supply tank. The controller is for actuating the replenishing means to control a replenishment quantity of the liquid to the supply tank. The operation selection switch is for selectively operating the controller in one of a first operation mode and a second operation mode. The controller is configured to keep a liquid level of the supply tank to a first liquid level in the first operation mode. The controller is configured to keep the liquid level of the supply tank to a second liquid level in the second operation mode. The second liquid level of the supply tank is higher than the first liquid level of the supply tank. With these configurations, the first level is configured to lessen the water head pressure in the supply tank so as to cause the breakups only at the tip of the Taylor cone, The second level is configured to relatively increase the water head pressure in the supply tank so as to cause the breakups at the portions other than the tip of the Taylor cone as well as at the tip of the Taylor cone. For this reason, the electrostatically atomizing device is capable of mainly generating the mist of the charged minute water particles of nanometer sizes in the first operation mode. The electrostatically atomizing device is capable of generating the mist of the charged minute water particles that the nanometer sizes and the micron sizes are mixed in the second operation mode.

It is preferred that the supply tank includes a first liquid level sensor and a second liquid level sensor. In this case, the controller is configured to operate the replenishing means so as to keep the liquid level of the supply tank to a liquid level which is determined by the first liquid level sensor in the first operation mode. The controller is configured to operate the replenishing means so as to keep the liquid level of the supply tank to a liquid level which is determined by the second liquid level sensor in the second operation mode. Therefore, it is possible for electrostatically atomizing device to have dual adjustment of the water head pressures applied to the liquid at the tip of the atomization nozzle.

It is preferred that the replenishing means includes a replenishing tank and a pump. The replenishing tank is configured to contain a volume of liquid and is connected to the supply tank. The pump is configured to supply the liquid from the replenishing tank to the supply tank.

It is preferred that the atomization nozzle includes a main tube and a capillary tube. The capillary tube extends continuously from the main tube and defines the emitter electrode. The main tube has an inside diameter sufficiently larger than that of the capillary tube so as to be free from a capillary action. The main tube has its rear end which is connected to the supply tank. With this configuration, it is possible to apply the water head pressure in the supply tank to the water which is held at the tip of the capillary tube through the main tube. In the second mode, a high water head pressure kept at the second level in the supply tank applies to the water held at the tip of the capillary tube. Therefore, it is possible for electrostatically atomizing device to generate the mist of the charged minute particles of nanometer sizes and micron sizes at the same time.

It is preferred that the capillary tube is coaxial with the main tube. The atomization nozzle is fixed to a housing with an axis of the atomization nozzle which is directed in the horizontal direction. The supply tank has a height along a direction perpendicular to an axis of the main tube. The first liquid level is located at a lowermost position for supplying the liquid from said supply tank to the main tube and the capillary tube. In this case of the first level, it is possible to only generate the mist of the charged minute water particles of nanometer sizes effectively by a regulation of the minimizing the water head pressure applied to the liquid supplied to the atomization nozzle.

BEST MODE FOR CARRYING OUT THE INVENTION

Figure 1:
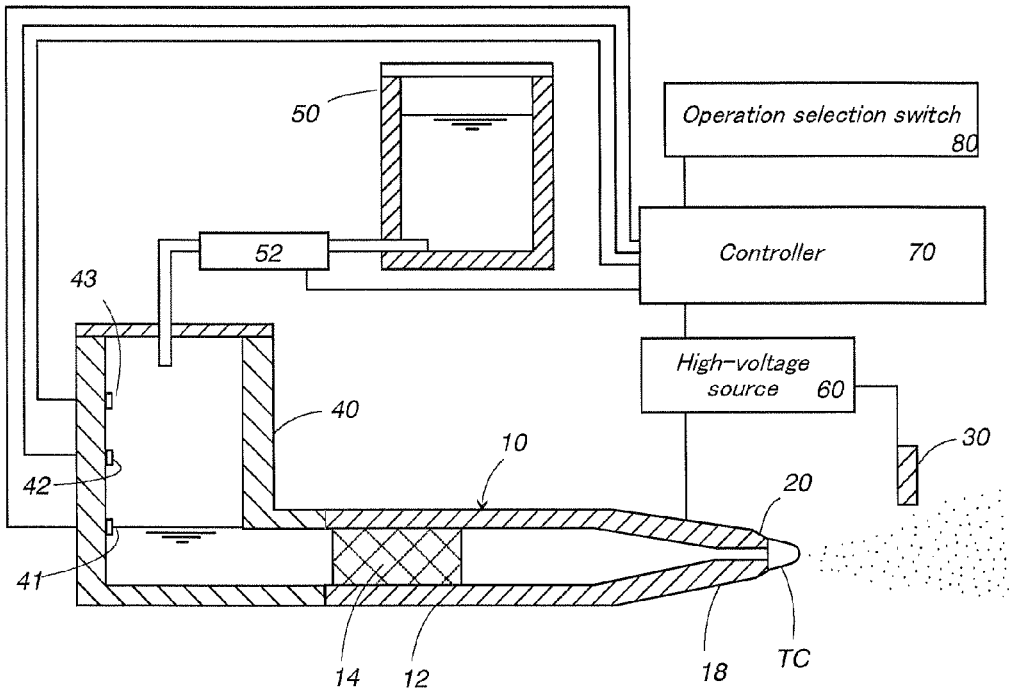
FIG. 1 shows a schematic view of an electrostatically atomizing device with operating the first operation mode in accordance with an embodiment.
Figure 2:
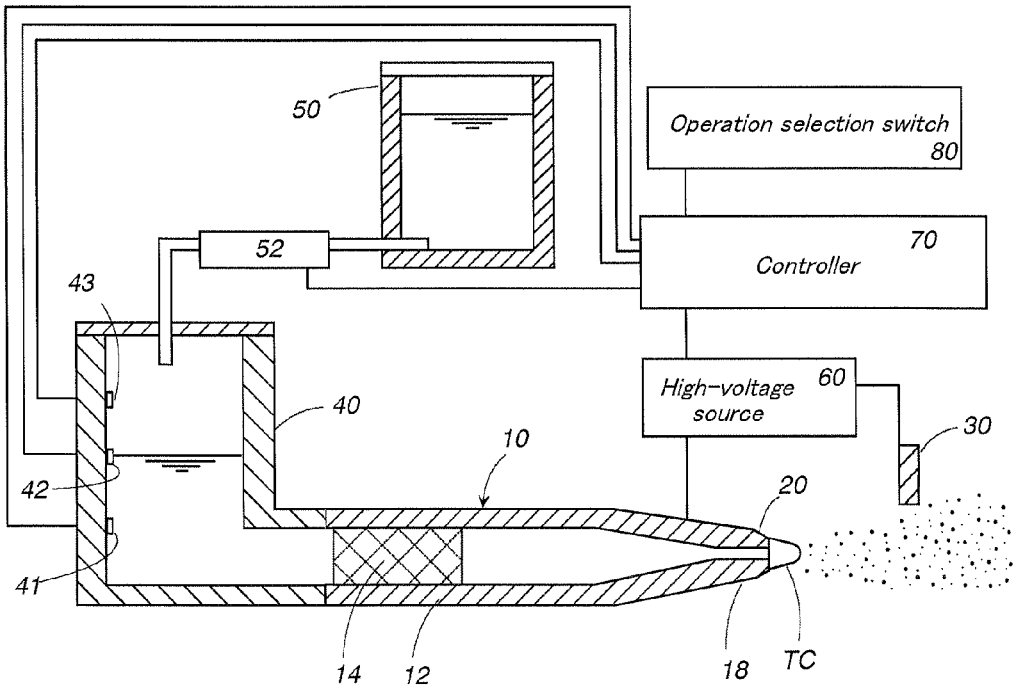
FIG. 2 shows a schematic view of the electrostatically atomizing device with operating the second operation mode of the above embodiment.

An electrostatically atomizing device in accordance with an embodiment of the present invention is explained with reference to attached drawings of FIG. 1 and FIG. 2. The electrostatically atomizing device comprises an atomization nozzle 10, an opposed electrode 30, a high-voltage source 60, a controller 70, and an operation selection switch 80. The atomization nozzle 10 is provided at its tip with an emitter electrode 20. The opposed electrode 30 is disposed in an opposed relation to the emitter electrode 20. The high-voltage source 60 is for applying a high-voltage between the emitter electrode 20 and the opposed electrode 30. The operation selection switch 80 is configured to be selectable between a first operation mode and a second operation mode for selectively operating the controller in one of the first operation mode and the second operation mode. In the first operation mode, the electrostatically atomizing device is configured to only generate a mist of charged minute particles of nanometer sizes of 3 nm to 100 nm. In the second operation mode, the electrostatically atomizing device is configured to generate a mist of charged minute particles of nanometer sizes with a mist of charged minute particles of micron sizes of 0.1 μm to 10 μm. The operation selection switch 80 applies the signals to the controller 70 for operating the electrostatically atomizing device in either the first operation mode or the second operation mode. As mentioned later, the controller 70 is configured to actuate a pressure applied to liquid supplied to the tip of the atomization nozzle 10 according to a selection of the first operation mode and the second operation mode. In addition, the controller 70 is configured to actuate a high-voltage value.

The atomization nozzle 10 has its rear end connected with the supply tank 40. The liquid, such as water, contained to the supply tank 40 is supplied to a tip of the emitter electrode 20. The electrostatically atomizing device in this invention is capable of using various liquids instead of the water. But this embodiment explains the electrostatically atomizing device which uses the water as the liquid.

The water supplied to the emitter electrode 20 develops to the water ball by a surface tension. The high-voltage source is configured to apply the high-voltage, such as −8 kV, to the emitter electrode 20, so as to generate a high-voltage electrical field between an emitter end at the tip of the emitter electrode 20 and the opposed electrode 30. The high-voltage electrical field electrostatically charges the water ball by static electricity, and subsequently causes the water ball to generate the mist of the charged minute particles M. The high-voltage between the emitter electrode 20 and the opposed electrode 30 causes a generation of the Coulomb force between the opposed electrode 30 and the water held at the tip of the emitter electrode 20. Therefore, the high-voltage pulls the water toward the opposed electrode 30 and forms a Taylor cone at a surface of the water, locally. A concentration of the electrical charge at the tip of the Taylor cone TC causes a larger electrical field intensity between the emitter end of the emitter electrode 20 and the opposed electrode, and causes a larger Coulomb force. In this way, the high-voltage electrical field further develops the Taylor cone. Subsequently, the Coulomb force becomes larger than the surface tension of the water W, thereby repeating the breakups of the Taylor cone and generating a large amount of the mist of the charged minute water particles of nanometer sizes. The mist of the charged minute water particles of nanometer sizes is discharged by airflow that an ion wind flowing from the emitter electrode 20 toward and through the opposed electrode 30 causes.

The supply tank 40 is replenished with the water from a replenishing tank 50 by a pump 52. The supply tank 40 is provided with water level sensors 41, 42, 43 which are arranged at different height levels and which are configured to output signals of water levels in the supply tank 40 to the controller 70. The controller 70 controls the pump 52 for keeping the water level to the first water level sensor 41 or the second water level sensor 42 according to the operation mode that the operation selection switch 80 is selected. The operation selection switch 80 cooperates with the replenishing tank 50, the pump 52, and the controller 70 to constitute a pressure regulating means which is configured to regulate the pressure applied to the water supplied at the tip of the emitter electrode 20 of the atomization nozzle 10.

The atomization nozzle 10 is formed into a tubular configuration and includes a main tube 12 and a capillary tube which extends continuously from the main tube. The capillary tube 18 is coaxial with the main tube 12. The capillary tube 18 defines the emitter electrode 20. The main tube 12 has an inside diameter which extends along the length from the supply tank 40 to the tip of the emitter electrode 20. The inside diameter has a sufficiently large diameter for not to generate a capillary action and is configured to apply a water head pressure to the water ball on the tip of the emitter electrode 20. The main tube 12 has an inside diameter which is tapered toward the capillary tube 18. The water applied to the emitter electrode 20, capillary tube 18, is developed into the water ball by the surface tension. The first water level sensor 41, the second water level sensor 42, and the third water level sensor 43 are arranged to apply the water head pressure of the water in the supply tank to the water ball without breaking the water ball formed by the surface tension. The water in the supply tank 40 applies the water head pressure to the Taylor cone TC which is formed by the high-voltage that the high-voltage source applies.

The atomization nozzle 10 is fixed to a housing and is disposed to have its central axis aligned with the horizontal direction. The supply tank 40 has its height along the vertical direction and is connected with a rear end of the atomization nozzle 10. The supply tank 40 has height along a direction perpendicular to an axis of the main tube 12. As shown in FIG. 1, the first water level sensor 41 is located at the lowermost position for filling the water to the atomization nozzle 10. When the water level of the supply tank corresponds to the position of the first water level sensor 41, the water in the supply tank applies a minimum water head pressure to the Taylor cone TC. The second water level sensor 42 is located above the first water level sensor 41. As shown in FIG. 2, when the supply tank 40 contains the water with the water level equally or lower than the second water level sensor 42 and higher than the first water level sensor 41, the water has a predetermined water head pressure higher than the minimum water head pressure and applies the predetermined water head pressure to the Taylor cone TC. The third water level sensor 43 determines a maximum value of the water head pressure that the water contained in the supply tank 40 generates. The Taylor cone receives the minimum water head pressure, generates breakups at its tip, and generates at its tip the mist of the charged minute water particles of nanometer sizes. The Taylor cone TC receives the predetermined water head pressure, generates the breakups at the tip of the Taylor cone and the portion other than the tip of the Taylor cone, and then generates the mist of the charged minute water particles of nanometer sizes and the mist of the charged minute water particles of micron sizes. The supply tank 40 is further supplied with the water by the replenishing tank 50 through the pump 52 and then contains more volume of the water. Finally, the controller 70 is configured to stop the pump 52 when the water level reaches the third water level sensor 43.

The Taylor cone TC has a shape which is maintained by the surface tension. The high-voltage source 60 is configured to apply the high-voltage to the Taylor cone TC which receives the predetermined water head pressure and causes the breakup of the portion of the tip of the Taylor cone where the electrically charge is concentrated. In addition, the high-voltage source 60 causes the portion other than the tip of the Taylor cone to break up. However, the portion other than the tip of the Taylor cone has little electrical-charge than the tip of the Taylor cone. Therefore, the portion other than the tip of the Taylor cone has little energy for breaking up. As a result, the portion other than the tip of the Taylor cone TC mainly generates the mist of the charged minute water particles of nanometer sizes. Therefore, the high-voltage source 60 applies the high-voltage to the Taylor cone TC which receives the water head pressure at the tip of the emitter electrode 20, and then causes the generation of the mist of the charged minute water particles of nanometer sizes at the tip of the Taylor cone. In addition, the high-voltage source causes the generation of the mist of the charged minute water particles of micron sizes at the portion other than the tip of the Taylor cone. The mist of the charged minute water particles of nanometer sizes and micron sizes spreads into the room in a diffused state. The supply tank 40 continuously supplies the water to the emitter electrode 20 and continuously forms the Taylor cone TC at the emitter electrode 20. Therefore, the Taylor cone TC generates the mist of the charged minute water particles, continuously.

The mist of the charged minute water particles of nanometer sizes includes radicals. The radicals in the mist of the charged minute water particles of nanometer sizes decompose harmful substances, sterilize substances in the room, and deodorize the substances in the room. The mist of the charged minute water particles of micron sizes spreads into the room and humidifies the room.

In addition, it is possible for supply tank 40 to further include yet another water level sensor in addition to the above mentioned water level sensors. In this case, it is preferred that the yet another water level sensor is configured to detect the water level between the first water level sensor and the third water level sensor. With this configuration, the controller 70 is capable of regulating the water level between the first water level sensor 41 and the third water level sensor 43. Therefore, it is possible to obtain the electrostatically atomizing device which is capable of controlling particle size distributions and generation ratio of the mist of the charged minute water particles of nanometer sizes.

Figure 3:
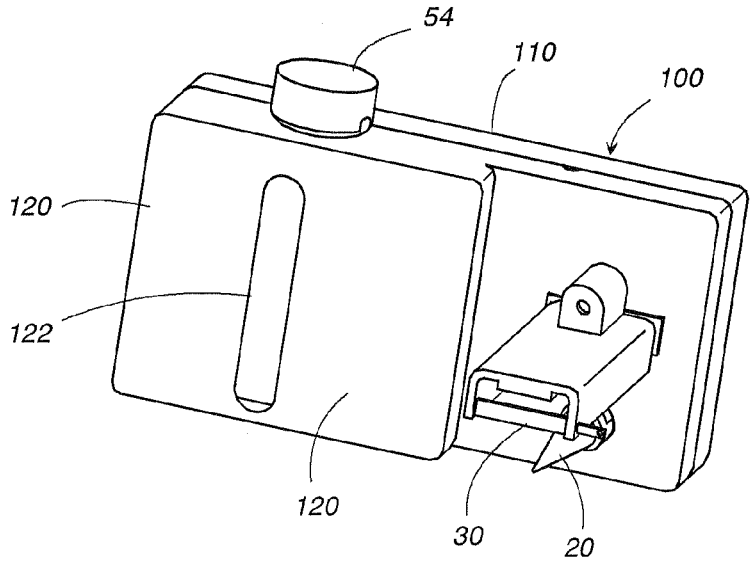
FIG. 3 shows a perspective view of the electrostatically atomizing device of above embodiment.
Figure 4:
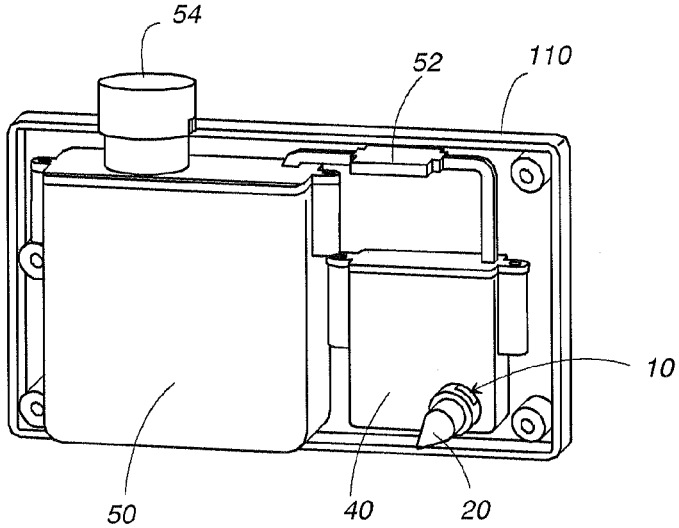
FIG. 4 shows a perspective view of the electrostatically atomizing device in a state of removing the cover of above embodiment.

FIG. 3 and FIG. 4 show the housing 100 which incorporates the parts constituting the electrostatically atomizing device. The housing 100 includes a base 110 and a cover 120 which covers the base 110. The base 110 is fixed with the supply tank 40, the atomization nozzle 10, the replenishing tank 50, and the pump 52. The atomization nozzle and supply tank 40 is formed integrally. The opposed electrode 30 is fixed to the cover 120. The emitter electrode 20 and the opposed electrode 30 are disposed at the outside of the housing. The electrical components which constitute the high-voltage source 60, the controller 70, and the pressure regulating means 80 are disposed in the housing 100. The cover 120 is provided with a window 122 which is for confirming the water level of the supply tank and which is made of transparent material. The replenishing tank 50 is provided with a cap 54. It is possible to supply the water into the replenishing tank 50 with removing the cap 54 as necessary In the electrostatically atomizing device of this embodiment shown in the Figure, the opposed electrode 30 is disposed at a front side of the emitter electrode 20 and is configured to cooperate with the emitter electrode 20 for generating the high-voltage therebetween. However, the electrostatically atomizing device of this invention is not to be considered limited to what is shown in the drawings. For example, it is possible to use a part of the housing 100 as a ground. In this case, the high-voltage source is configured to apply the high-voltage between the emitter electrode 20 and a part of the housing 100. The air which surrounds the emitter electrode 20 acts as a ground potential. The air acts as a ground potential around the emitter electrode 20. The emitter electrode 20 is capable of generating the mist of the charged minute water particles.

The atomization nozzle 10 is provided with a filter 14. The filter 14 is for filtering the water, thereby removing minerals such as Calcium and Magnesium from the water. In the case of using a tap water to the electrostatically atomizing device of this invention, the filter 14 prevents the minerals of the tap water from depositing at the tip of the emitter electrode 20.

Figure 5:
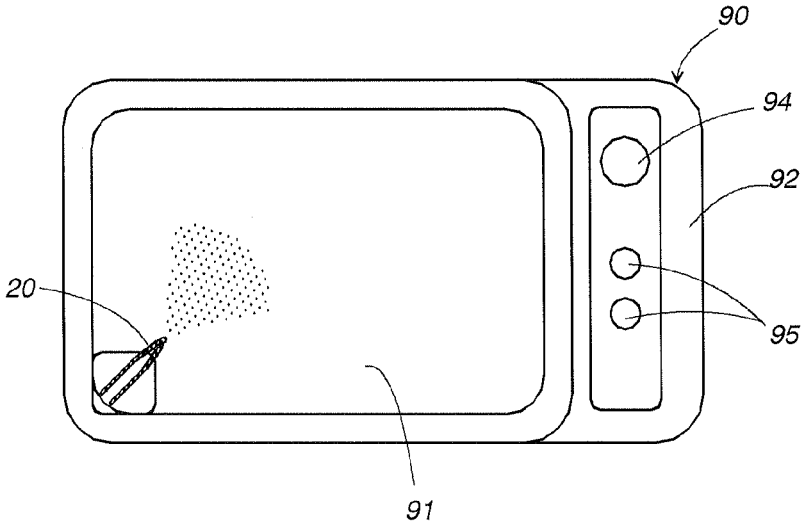
FIG. 5 shows a schematic view of a food storage chamber with the electrostatically atomizing device of above embodiment.

FIG. 5 shows a food storage chamber 90 which is configured to store foods such as vegetables. The food storage chamber 90 has an electrostatically atomizing device M. The food storage chamber 90 allows the electrostatically atomizing device M to generate the mist of the charged minute water particles of nanometer sizes and micron sizes for deodorizing substances, sterilizing the substances, and decomposing harmful substances to an inside of the food storage chamber 90. In addition, the mist of the charged minute water particles of micron sizes maintains the inside of the food storage chamber 90 at a proper humidity. Especially, in the case of containing the vegetables in the food storage chamber 90, the food storage chamber 90 is capable of supplying a large amount of the mist of the charged minute water particles of micron sizes to the vegetables. Therefore, it is possible to obtain the food storage chamber which is capable of preserving the freshness of the vegetables.

The food storage chamber 90 is provided with a heat insulator 92, a power switch 94, and a temperature regulating buttons 95. The heat insulator 92 is configured to keep the inside of the food storage chamber 90 to a predetermined temperature, The power switch 94 and the temperature regulating buttons 95 are located at an exterior surface of the food storage chamber 90. The electrostatically atomizing device M is configured to start by the power switch 94. The electrostatically atomizing device M is configured to operate according to the selected operation mode of the operation selection switch 80 so as to generate only the mist of the charged minute water particles of nanometer sizes or generate the mist of the charged minute water particles of nanometer sizes with that of micron sizes.

In the foods, it is known that the leafy vegetables are not capable of preserving the freshness by only wetting a leaf surface. It is possible for leafy vegetables to preserve the freshness by supplying the water to tissues through stomata. Leafs of the leafy vegetables have stomata which have long sides of about 100-200 μm and have short sides of about 10 μm. The mist of the charged minute water particles of nanometer sizes penetrates into the tissue through the stomata. However, the mist of the charged minute water particles of nanometer sizes has extremely small particle sizes. It is impossible to supply a sufficient amount of water to the tissue of the leafy vegetables through the stomata by the mist of the charged minute water particles of nanometer sizes. On the other hand, the mist of the charged minute water particles of micron sizes contains much amount of water than that of micron sizes. Therefore, it is possible to preserve the freshness of the leafy vegetables through the stomata by the mist of the charged minute water particles of micron sizes. In the case of incorporating the electrostatically atomizing device into the food storage chamber 90, it is preferred that the second operation mode is configured to generate the mist of the charged minute water particles of micron sizes with particle size distributions of less than 10 micrometer. It is more preferred that the second operation mode is configured to generate the mist of the charged minute water particles of micron sizes with the particle size distributions of less than 1.0 to 3.0 micrometer.

The mist of the charged minute water particles of nanometer sizes is capable of sterilizing and deodorizing surfaces of the leafy vegetables and is capable of decomposing the harmful substances such as agrichemicals adhering to the leafy vegetables. In addition, the mist of the charged minute water particles of nanometer sizes is capable of penetrating into the tissues of the leafy vegetables through the stomata, and then is capable of decomposing the agrichemicals previously penetrating into the tissues, sterilizing and deodorizing the inside of the tissue. In this case, the pressure regulating means and high-voltage source are controlled to generate the mist of the charged minute water particles of nanometer sizes having the particle size distributions of 15 to 30 nanometers.

The above configuration shows the example of this invention of the electrostatically atomizing device which is incorporated into the food storage chamber 90. However, the invention is not to be considered limited to what is shown in the drawing and described in the specification. The electrostatically atomizing device is capable of using at the room where the mist of the charged minute water particles of nanometer sizes is required. Or more specifically, the electrostatically atomizing device is capable of using at the room where the mist of the charged minute water particles of nanometer sizes with that of micron sizes are required.

The invention claimed is:

1. An electrostatically atomizing device comprising:

a tubular atomization nozzle having an emitter electrode at its tip;

a supply tank being configured to contain a volume of liquid and supply the liquid to said atomization nozzle;

a high-voltage source being configured to apply a high voltage to the emitter electrode in order to electrostatically charge the liquid supplied thereto for generating a mist of charged minute liquid particles from the tip of the emitter electrode; and a pressure regulating means configured to regulate a pressure applied to the liquid at the tip of said atomization nozzle, wherein said pressure regulating means comprises:

a replenishing means for replenishing the liquid to said supply tank;

a controller for actuating said replenishing means to control a replenishment quantity of the liquid to said supply tank; and an operation selection switch for selectively operating the controller in one of a first operation mode and a second operation mode, wherein said controller is configured to keep a liquid level of said supply tank to a first liquid level in said first operation mode, whereby the liquid in the tank maintains application of a first water head pressure supplied to the atomization nozzle, wherein said controller is configured to keep the liquid level of said supply tank to a second liquid level in said second operation mode, and said second liquid level of said supply tank is higher than said first liquid level of said supply tank, whereby the liquid in the tank maintains application of a second water head pressure supplied to the atomization nozzle, and wherein said second water head pressure is higher than said first water head pressure, said atomization nozzle including a main tube which is provided at its tip with said emitter electrode, said main tube being configured to transmit the water head pressure to the tip of said emitter electrode without applying pressure when the liquid of said tank generates the water head pressure, said main tube having one end, said one end of said main tube being connected to said tank such that said one end is located below the first liquid level and the second liquid level.

2. The electrostatically atomizing device as set forth in claim 1, wherein said supply tank includes a first liquid level sensor and a second liquid level sensor, said controller is configured to operate said replenishing means so as to keep the liquid level of said supply tank to a liquid level determined by said first liquid level sensor in said first operation mode, and said controller is configured to operate said replenishing means so as to keep the liquid level of said supply tank to a liquid level determined by said second liquid level sensor.

3. The electrostatically atomizing device as set forth in claim 1, wherein said replenishing means includes a replenishing tank configured to contain a volume of liquid and connected to the supply tank, and a pump configured to supply the liquid from said replenishing tank to said supply tank.

4. The electrostatically atomizing device as set forth in claim 1, wherein said atomization nozzle includes a capillary tube which extends continuously from said main tube and which defines said emitter electrode, said main tube has an inside diameter sufficiently larger than that of said capillary tube so as to be free from a capillary action, and said main tube has its rear end connected to said supply tank.

5. The electrostatically atomizing device as set forth in claim 4, wherein said capillary tube is coaxial with said main tube, said atomization nozzle is fixed to a housing with an axis of said atomization nozzle being directed in the horizontal direction, said supply tank has a height along a direction perpendicular to an axis of said main tube, and said first liquid level is located at a lowermost position for supplying the liquid from said supply tank to said main tube and said capillary tube.

6. An electrostatically atomizing device comprising:

a tubular atomization nozzle having an emitter electrode at its tip;

a supply tank being configured to contain a volume of liquid and supply the liquid to said atomization nozzle;

a high-voltage source being configured to apply a high voltage to the emitter electrode in order to electrostatically charge the liquid supplied thereto for generating a mist of charged minute liquid particles from the tip of the emitter electrode; and a pressure regulating means configured to regulate a pressure applied to the liquid at the tip of said atomization nozzle, wherein said electrostatically atomizing device has a first operation mode and a second operation mode, said electrostatically atomizing device in the first operation mode is configured to generate the mist of the charged minute liquid particles of nanometer sizes, said electrostatically atomizing device in the second operation mode is configured to generate the mist of the charged minute liquid particles of the nanometer sizes and micron sizes, said pressure regulating means is configured to regulate the pressure applied to the liquid at the tip of said atomization nozzle according to said operation mode, the pressure is a water head pressure, the pressure regulating means is configured to maintain application of a first water head pressure when the electrostatically atomizing device has the first operation mode, the pressure regulating means is configured to maintain application of a second water head pressure when the electrostatically atomizing device has the second operation mode, and the second water head pressure is higher than the first water head pressure, said atomization nozzle including a main tube which is provided at its tip with said emitter electrode, said main tube of said atomization nozzle being configured to transmit the water head pressure to the liquid at the tip of said emitter electrode without applying pressure when the liquid in said tank generates the water head pressure, said main tube having one end, said one end of said main tube being connected to said tank such that said one end is located below the first liquid level and the second liquid level.

7. The electrostatically atomizing device as set forth in claim 6, wherein said pressure regulating means comprises:

a replenishing means for replenishing the liquid to said supply tank;

a controller for actuating said replenishing means to control a replenishment quantity of the liquid to said supply tank; and an operation selection switch for selectively operating the controller in one of the first operation mode and the second operation mode, wherein said controller is configured to keep a liquid level of said supply tank to a first liquid level in said first operation mode, and wherein said controller is configured to keep the liquid level of said supply tank to a second liquid level in said second operation mode, said second liquid level of said supply tank is higher than said first liquid level of said supply tank.

8. The electrostatically atomizing device as set forth in claim 7, wherein said supply tank includes a first liquid level sensor and a second liquid level sensor, said controller is configured to operate said replenishing means so as to keep the liquid level of said supply tank to a liquid level determined by said first liquid level sensor in said first operation mode, and said controller is configured to operate said replenishing means so as to keep the liquid level of said supply tank to a liquid level determined by said second liquid level sensor.

9. The electrostatically atomizing device as set forth in claim 7, wherein said replenishing means includes a replenishing tank configured to contain a volume of liquid and connected to the supply tank, and a pump configured to supply the liquid from said replenishing tank to said supply tank.

10. The electrostatically atomizing device as set forth in claim 7, wherein said atomization nozzle includes capillary tube which extends continuously from said main tube and which defines said emitter electrode, said main tube has an inside diameter sufficiently larger than that of said capillary tube so as to be free from a capillary action, and said main tube has its rear end connected to said supply tank.

11. The electrostatically atomizing device as set forth in claim 10, wherein said capillary tube is coaxial with said main tube, said atomization nozzle is fixed to a housing with an axis of said atomization nozzle being directed in the horizontal direction, said supply tank has a height along a direction perpendicular to an axis of said main tube, and said first liquid level is located at a lowermost position for supplying the liquid from said supply tank to said main tube and said capillary tube.

12. The electrostatically atomizing device as set forth in claim 1, wherein said first water head pressure and said second water head pressure are hydrostatic pressure.

13. The electrostatically atomizing device as set forth in claim 7, wherein said first water head pressure and said second water head pressure are hydrostatic pressure.

14. An electrostatically atomizing device comprising:

a tubular atomization nozzle having an emitter electrode at its tip;

a supply tank being configured to contain a volume of liquid and supply the liquid to said atomization nozzle;

a high-voltage source being configured to apply a high voltage to the emitter electrode in order to electrostatically charge the liquid supplied thereto for generating a mist of charged minute liquid particles from the tip of the emitter electrode; and a pressure regulating means configured to regulate a pressure applied to the liquid at the tip of said atomization nozzle, wherein said pressure regulating means comprises:

a replenishing means for replenishing the liquid to said supply tank;

a controller for actuating said replenishing means to control a replenishment quantity of the liquid to said supply tank; and an operation selection switch for selectively operating the controller in one of a first operation mode and a second operation mode, said controller is configured to keep a liquid level of said supply tank to a first liquid level in said first operation mode, whereby the liquid in the tank keeps on applying a first water head pressure supplied to the atomization nozzle, and said controller is configured to keep the liquid level of said supply tank to a second liquid level in said second operation mode, said second liquid level of said supply tank is higher than said first liquid level of said supply tank, whereby the liquid in the tank keeps on applying a second water head pressure supplied to the atomization nozzle, wherein said second water head pressure is higher than the first water head pressure, wherein when the liquid in said tank generates the water head pressure, said atomization nozzle is configured to transmit pressure to the liquid at the tip of said emitter electrode, the pressure transmitted to the liquid at the tip of said emitter electrode being the water head pressure only.

* * * * *